US005743485A

United States Patent [19]

Martorelli et al.

[11] Patent Number: 5,743,485

[45] Date of Patent: Apr. 28, 1998

[54] WALL SURFACE-ATTACHABLE TOOL FOR HANDS-FREE SUPPORT OF ROLL OF WALLPAPER BORDER

[75] Inventors: James E. Martorelli, Palm Bay; Thomas E. Sepanik, Indialantic, both of Fla.

[73] Assignee: Jim's Wallpaper and Painting, Palm Bay, Fla.

[21] Appl. No.: 701,251

[22] Filed: Aug. 21, 1996

[51] Int. Cl.[6] ..... B65H 16/02

[52] U.S. Cl. ..... 242/597.7; 242/406; 242/597.5; 242/597.8; 156/577

[58] Field of Search ..... 242/597, 597.7, 242/597.8, 588, 588.1, 588.2, 405.3, 406, 597.5; 156/577

[56] References Cited

U.S. PATENT DOCUMENTS

| | | | |
|---|---|---|---|
| D. 237,459 | 11/1975 | Wagner, Sr. | 242/597.8 X |
| 272,436 | 2/1883 | Heffernan . | |
| 414,527 | 11/1889 | Gwyn . | |
| 778,272 | 12/1904 | Roop . | |
| 888,896 | 5/1908 | Howard . | |
| 1,318,945 | 2/1919 | Wyborski . | |
| 1,797,854 | 3/1931 | Carter . | |
| 1,818,514 | 8/1931 | Whitaker | 242/588.1 |
| 2,068,755 | 1/1937 | Miller | 242/597.7 X |
| 2,447,764 | 8/1948 | McCain | 248/360 |
| 2,555,531 | 6/1951 | Boord . | |
| 2,681,187 | 6/1954 | Zettelmeyer | 242/597.1 |
| 2,988,768 | 6/1961 | Hill . | |
| 2,994,488 | 8/1961 | Waddell | 242/597.5 |
| 3,204,908 | 9/1965 | Brown | 248/226 |
| 3,432,875 | 3/1969 | Edelson | 15/246 |
| 4,263,347 | 4/1981 | Banta | 427/282 |
| 4,714,211 | 12/1987 | Hwang | 242/588 X |
| 4,757,568 | 7/1988 | Jones | 15/105 |
| 4,821,361 | 4/1989 | Meimeteas | 15/246 |
| 4,887,327 | 12/1989 | Meimeteas | 15/246 |
| 5,125,609 | 6/1992 | Demeo | 242/597.7 X |
| 5,193,758 | 3/1993 | Laager et al. | 242/597.7 |
| 5,328,543 | 7/1994 | Campagna | 156/577 X |
| 5,453,152 | 9/1995 | Mazzola et al. | 156/577 |
| 5,497,958 | 3/1996 | Orf et al. | 242/597.7 |

*Primary Examiner*—William Stryjewski
*Assistant Examiner*—William A. Rivera
*Attorney, Agent, or Firm*—Charles E. Wands

[57] ABSTRACT

A 'hands-free' wall-attachable web storage tool comprises a generally elongate body member, having a handle portion and a distal end portion. A grip is affixed to the handle end portion and an end cap is fitted over the distal end portion. Wall surface-piercing probe elements are affixed at an acute angle to the distal end of the body member. Each of the pointed probe elements is inserted through a respective sleeve-configured stand-off. For supporting a roll of web material, a generally L-shaped shaft member is affixed to the generally elongate body member. The L-shaped rod has a leg spaced apart from the distal end portion of the generally elongate body member, which receives and supports the roll of web material in proximity with the distal end of the elongate body member. A clip element is mounted to the generally elongate body member to allow the tool to hang from the hanger's belt or pants pocket in a safe orientation when not in use.

17 Claims, 3 Drawing Sheets

WALL SURFACE-ATTACHABLE TOOL FOR HANDS-FREE SUPPORT OF ROLL OF WALLPAPER BORDER

FIELD OF THE INVENTION

The present invention relates in general to devices used in the application of web material, such as a rolled wallpaper border, to a vertical surface, and is particularly directed to a new web/wallpaper border-holding tool, that is readily self-attachable to a wall surface, wall board, wood and the like, for supporting a roll of web material, such as a roll of wallpaper border, by way of a wall surface, in such a manner as to readily enable a wallpaper installer to remove the wallpaper border, as needed, for application to the wall surface.

BACKGROUND OF THE INVENTION

A problem frequently faced by a professional wallpaper hanger is how to support a roll of web material, such as a roll of wallpaper border, particularly one that is to be applied to the wall surface adjacent to a high ceiling. The task is normally accomplished by an installer, with the use of a ladder or scaffold and assistance by a helper, who holds the roll of wallpaper border material and unrolls the material as needed by the installer. It goes without saying that the job is both labor intensive and cumbersome for both the installer and the helper. If the wallpaper hanger decides to install the wallpaper border himself, one hand must hold the border, while the other is doing all the application work (smoothing, gluing, washing, cutting). In other words, he becomes a 'one armed paperhanger'.

SUMMARY OF THE INVENTION

In accordance with the present invention, this problem is effectively eliminated by a dual use, web/wallpaper border-holding tool, that is configured to be easily and removably attached to a wall surface by a single individual. Once properly engaged with the wall surface either a two-prong attachment mode, or a three-prong attachment mode, the wallpaper border-holding tool of the present invention will remain effectively self-attached to the wall, securely supporting a roll of web/wallpaper border material in proximity to the wall surface, in a manner that facilitates the installer's unrolling of border material, as needed, for application to an adjacent area of the wall surface.

For this purpose, the wall-attachable web/wallpaper holding tool of the present invention comprises a generally elongate body member, such as a rectilinear metallic rod, shaft or the like, having a handle portion and a distal end portion. A rubber or vinyl sleeve is affixed to the handle end of the elongate body member, to facilitate secure gripping of the tool by the user. Similarly, an end cap is fitted over the distal end portion of the elongate body member, so as to protect the wall surface from being scarred by the metallic rod in the course of the installer handling the tool along the wall surface.

In order for the tool to become attached to a wall surface, a plurality of pointed, hard steel, probe elements are affixed to and project radially outwardly from the distal end portion of the generally elongate body member for enabling the tool to be securely attached to a wall surface in either the two prong or three prong mode. The pointed probe elements are attached at an acute angle to the distal end of the body member. A slight acute inclination of a pair of the probe elements serves to maintain the wall-piercing probe elements at a downwardly tilted angle into the wall surface. A third probe point is used to pierce the wall as a fulcrum point, when used for soffit-restricted access.

For supporting a roll of wallpaper border, a generally L-shaped shaft member or rod is affixed to the generally elongate body member. This L-shaped rod has a first leg attached to the elongate body member between its handle and distal end portions, and a second leg continuous with and tilted at an obtuse angle other than 90° relative to the first leg, so that the second leg is not parallel to the axis of the elongate body member. The effect of this slight obtuse angle offset is to make the second leg generally parallel to the wall surface, when the tool is self-attached to the wall surface. In addition, the second leg is spaced apart from the distal end portion of the generally elongate body member, so as to allow the second leg to receive and support the roll of wallpaper border material in proximity with the distal end of the elongate body member. As an additional feature, the tool includes a clip element that is inserted into a handle gripping sleeve element on the generally elongate body member adjacent to the first leg of the generally L-shaped rod. This allows the tool to hang from a user's belt, pants pocket or the like, when not in use, such that the probe elements face away from the user, as a safety measure.

DETAILED DESCRIPTION

Figure 1:
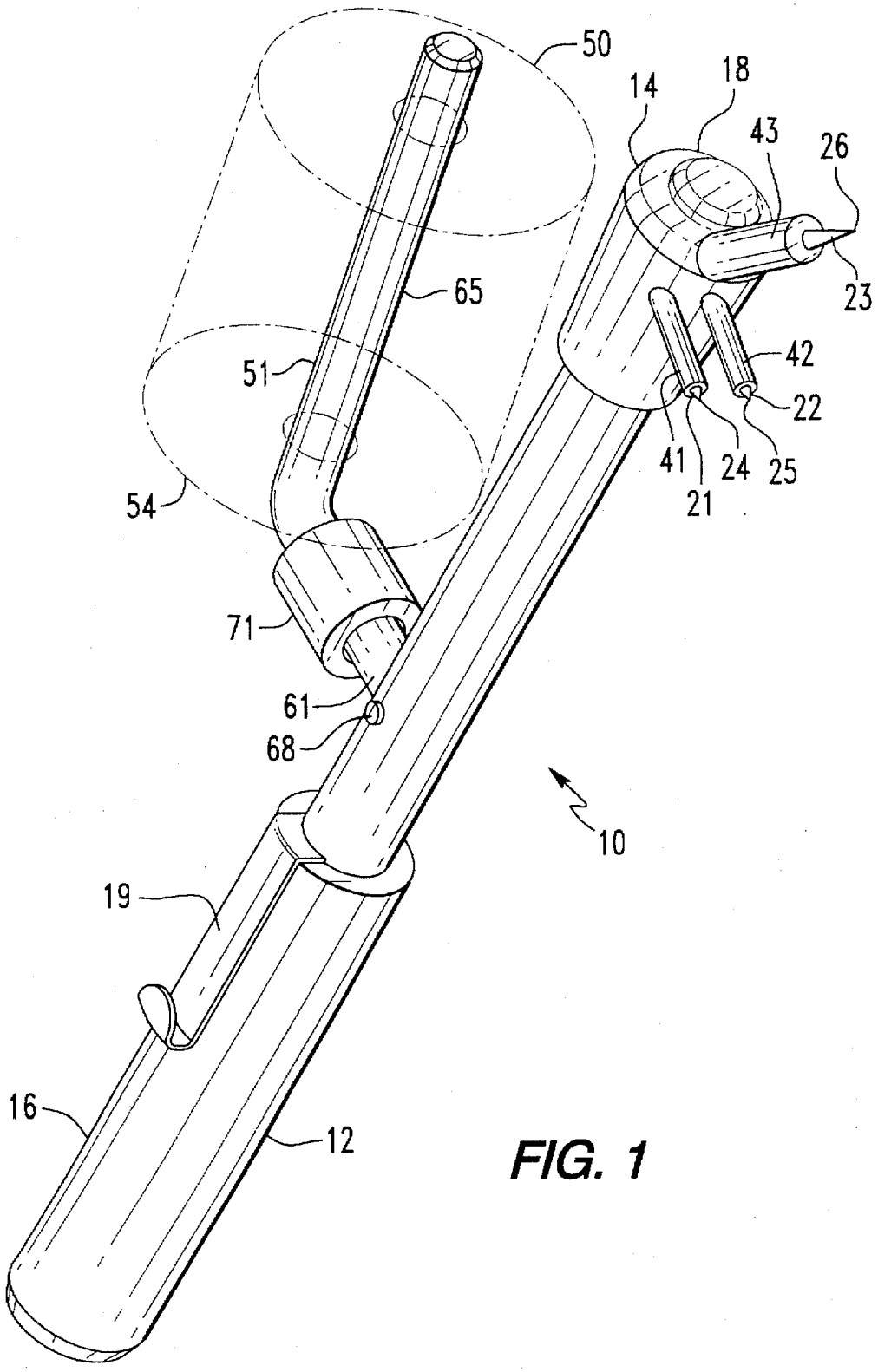
FIG. 1 is a diagrammatic perspective view of an embodiment of the wall-attachable border-holding tool according to the present invention.
Figure 2:
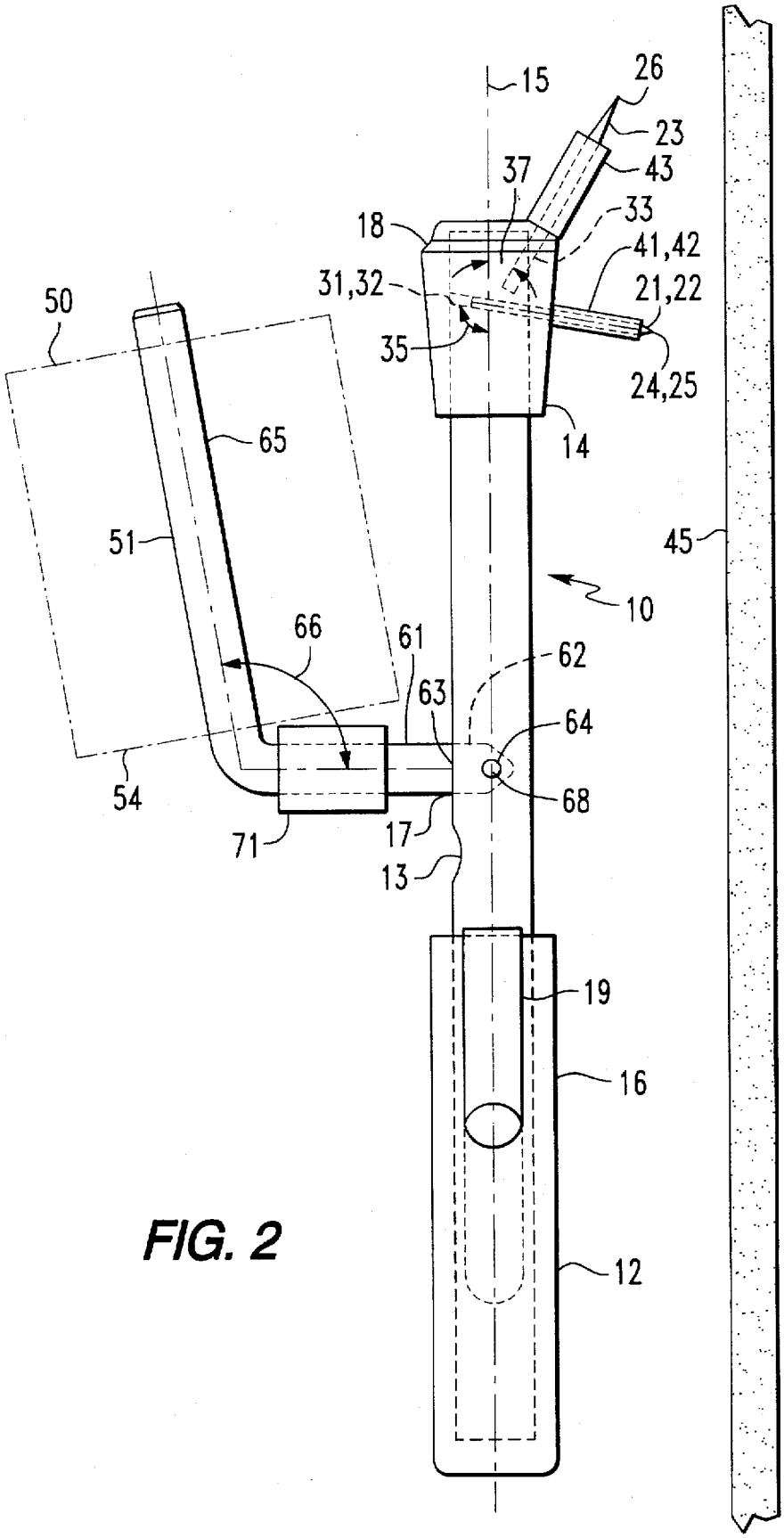
FIG. 2 is a diagrammatic side view of the wall-attachable border-holding tool of FIG. 1.

Referring now to FIGS. 1 and 2, an embodiment of the 'hands-free' wall-attachable web/wallpaper border-holding tool according to the present invention is diagrammatically illustrated as comprising a generally elongate body member 10, such as a rectilinear metallic rod, shaft or the like, for example a twelve inch section of ¾" diameter solid aluminum rod. The elongate body member 10 has a handle portion 12 through which the user grips the tool, and a distal end portion 14 that is configured to 'grip' the wall. The outer surface of the elongate body member 10 is configured to include an indented surface portion or dimple 13 adjacent to a location 17 thereof at which a generally L-shaped web/wallpaper border roll support element is affixed. This indented surface portion 13 serves to facilitate the user's gripping the handle portion 12 of the elongate body member 10 in the proper orientation.

A section 16 of high friction, cushioning grip material, conforming with the dimensions of a human hand, such as a section of rubber or vinyl sleeve, is affixed to the handle end portion 12 of the elongate body member 10, so as to facilitate secure gripping of the tool by the user. Because this rubber sleeve 16 is snuggly affixed to the elongate body member 10, a clip element 19 may be inserted between the rubber sleeve 16 and the elongate body member 10, so as to allow the tool to hang from the hanger's belt, pants pocket or the like, when not in use, such that the probe elements are in a safe orientation, facing generally away from the user. An end cap 18 of rubber, vinyl or the like, is fitted over the distal end portion 14 of the elongate body member, so as to protect the wall surface from being scarred by the metallic rod 10, in the course of the installer handling the tool along the wall surface.

In order for the tool to become attached to a wall surface, a plurality of pointed, wall surface-piercing elements, such as triad of sharp pointed, hard steel (e.g., stainless steel), probe or pin elements 21, 22 and 23 are affixed to and project radially outwardly from the distal end portion 14 of the generally elongate body member 10. These pointed probe elements may be securely and fixedly attached to the distal end 14 of the body 10 by drilling respective bores 31, 32 and 33 into the distal end 14 of the elongate body member 10, and bonding the probe elements into the bores. For the pin elements 21 and 22, the bores are inclined at an obtuse angle 35 with respect to the longitudinal axis 15 of the body member 10. The magnitude of the acute angle 35 (which may be on the order of 100°, as a non-limiting example) is such that the probe elements 21 and 22 project at a slight inclination toward the handle end 12 of the generally elongate body member 10. For the pin element 23, its associated bore 33 is inclined at an acute angle 37 with respect to the longitudinal axis 15 of the body member 10. The magnitude of the acute angle 37 (which may be on the order of 60°, as a non-limiting example) such that the probe element 23 projects at an inclination away from the handle end 12 of the generally elongate body member 10, so as to form a fulcrum point and cooperating with probe elements 21 and 22 to maintain the handle 12 away from or 'off' the surface of the wall 45 for a first mode of use of the tool, to be described below with reference to FIG. 3.

In an alternative mode of use of the tool, to be described below with reference to FIGS. 4 and 5, the third probe element is not necessarily used, and the pins 21 and 22 serve as the main attachment points. In this mode of use, the slight obtuse inclination of the probe elements 21, 22 serves to maintain the wall-piercing probe elements at a downwardly tilted angle into the wall surface 45, with the handle end 12 of the tool resting against the wall, so that the pins 21 and 22 are always oriented in a (slightly downward) direction that tends to bias the tool toward the wall, and thereby securely hold the tool against the wall.

The probe elements are used in conjunction with associated stand-offs 41–43, to be described, so as to provide a fulcrum and rotationally bias the handle end 12 of the tool toward the wall surface 45, once the probe elements have been inserted into the wall surface, thus providing multi-point support for the elongate tool body 10 against the wall surface 45. When the tool is not in use, to protect both the user and the points of the hard steel, pointed probe elements, a protective material, such as a plastic or rubber or the like, or a protective cover may encase the points of the probe elements.

The pointed probe elements 21–23 are inserted through respective sleeve-configured stand-offs 41–43, such as sections of rubber tubing, such that the respective pointed ends 24–26 of the probe elements 21–23 extend beyond the ends of the stand-offs 41–43. As a consequence, the depth to which the probe elements 21–23 may be inserted into the wall surface 45 is limited by the lengths of the projections of the pointed ends of the probe elements beyond the ends of the stand-offs 41–43. The lengths of the probe elements and their associated stand-offs, in combination with the distance between these elements and handle end of the body 10, will define a rotational fulcrum for the handle end portion 12 of the elongated body member 10 to be rotationally biased toward the wall surface 45, once the probe elements have been inserted into the wall surface.

As a non-limiting example, probe elements 21 and 22 may have a length on the order of one inch, with their associated stand-off sleeves 41 and 42 having a length on the order of seven-eighths of an inch, leaving a probe point distance on the order of an eighth of an inch for insertion into the wall surface 45. Probe elements 23 may have a slight arc and a length on the order of one and one-half inches, with its associated stand-off sleeve 43 having a length on the order of one inch, leaving a probe point distance on the order of one-half an inch for insertion into the wall surface 45. These parameters provide a rotational bias of the tool, as described above, and allow the tool to be used in a working area having a depth on the order of three inches.

Figure 3:
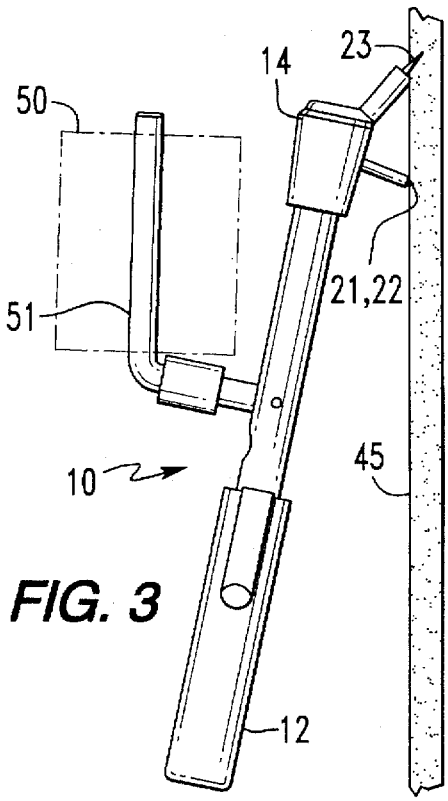
FIGS. 3, 4 and 5 diagrammatically illustrate the use of the border-holding tool shown in FIGS. 1 and 2.

In the first mode of use of the tool, shown in FIG. 3, the tool is mounted to the wall surface in an acute angle wall-mounted condition, so that the two wall surface-piercing probe elements 21 and 22 and the probe element 23 form a vertical 'tripod', that stabilizes the web support tool against the wall surface.

A roll of web/wallpaper border material, shown in broken lines 50, is rotationally mounted on a shaft member 51, that is supported on and in spaced apart relationship to the generally elongate body member 10. As a result, once the generally elongate body member 10 is self-attached to and 'tripod'-stabilized with the vertical wall surface 45, the roll of web material may be retained on shaft member 51 in spaced apart relation to the wall surface 45.

For this purpose, the web roll-supporting shaft member 51 may comprise a generally L-shaped rod or the like, for example, a section of three-quarter inch diameter solid aluminum rod, having a first leg or segment 61 attached to a location 63 of the generally elongate body member 10 between the handle end portion 12 and the distal end portion 14 thereof. The attachment location 63 may comprise a bore 62, drilled transverse to the longitudinal axis 15, and sized to snugly receive the first leg portion 61 of the generally L-shaped rod 51. A second bore 64, transverse to and intersecting bore 62 may also be drilled into the elongate body member 10. This second bore 64 may receive a pin 68 or the like, so as to secure the first leg 61 of the L-shaped rod in the elongate body member 10.

By generally L-shaped is meant that the web roll-supporting rod 51 has a second leg or segment 65 which is continuous with and tilted at an obtuse angle 66 relative to the first leg, so that the second leg is not parallel to the axis 15 of the elongate body member 10. Such an obtuse angle 66 between the first and second legs of L-shaped rod 51 may be on the order of 100°, as a non-limiting example. The effect of this slight obtuse angle offset is to make the second leg 65 generally parallel to the wall surface 45 as a result of the above-described 'tripod' mounting configuration of the tool, when the tool is self-attached to the wall surface.

In addition, with such a generally L-shaped configuration, when the first leg 61 of the L-shaped rod 51 is securely attached into bore 62 in the elongate body member 10, the second leg 65 is disposed alongside, but is spaced apart from the distal end portion 14 of the generally elongate body member 10, so as to allow the second leg 65 to receive and support the roll of web material 50 in proximity with the distal end 14 of the elongate body 10. As a non-limiting example, the first leg 61 may have a length sufficient to provide for a separation between the second leg 65 and the distal end portion 14 of the elongate body 10 by a distance on the order of two and one-half inches.

The web roll-supporting shaft member 51 is also configured to provide for rotation of the roll 50 of web material for ease of removal of material from the roll. For this purpose, the first leg 61 includes a freely rotatable sleeve or section of tubing 71, upon which the lower end 54 of wallpaper border rests. As the roll of wallpaper border is rotated about leg 65 and unwound, the sleeve 71 rotates, thereby facilitating the rotation of the bottom 54 of the wallpaper roll 50 about leg 65.

In a first mode of use of the tool diagrammatically illustrated in FIG. 3, such as in a soffet-restricted wall area, an individual, such as a wallpaper hanger, grips the elongate body member 10 by means of its handle 12, and thrusts the probe element 23 on the distal end portion 14 of the tool into a region of a wall surface that is to eventually be covered by the web material and which is adjacent to an area that is to be immediately covered by the wallpaper border held by the tool. This thrust motion of the distal end of the tool 45 drives the upper probe element 23 into the wall surface 45, so that the distal end 14 of the tool effectively becomes embedded into the wall surface 45. The two adjacent probe elements 21 and 22 then 'lock' the tool in place by a downward motion of the handle end 12, forming a secure 'tripod' mount to the wall surface. Because of the engagement of the probe element 23 into the wall and the slightly downward inclination of the probe elements 21 and 22 into the wall, the handle end 12 of the tool is rotationally biased away from the wall surface, so as to facilitate access to the handle by the wallpaper hanger. With a roll of web material, e.g., wallpaper border, mounted on shaft member 51, the installer may now readily install already unrolled web material and then 'tack' the unrolled portion of the web material to the adjacent wall surface, while working on the mounted material with both hands available.

A roll of pre-pasted wallpaper border may be mounted 'wet' on the shaft 51, to facilitate direct application to an adjacent wall surface as the roll is unwound. Then, as the unrolled web is applied to the wall surface adjacent to the area against which the tool is tacked, the installer simply grips the handle, pulling out the distal end of the tool, and tacks the tool to an adjacent area of the wall surface to be covered.

Figure 4:
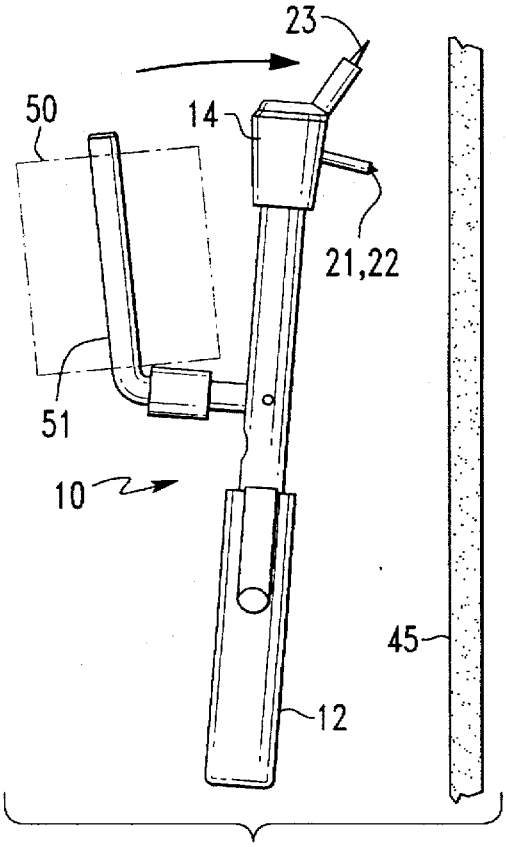
Figure 5:
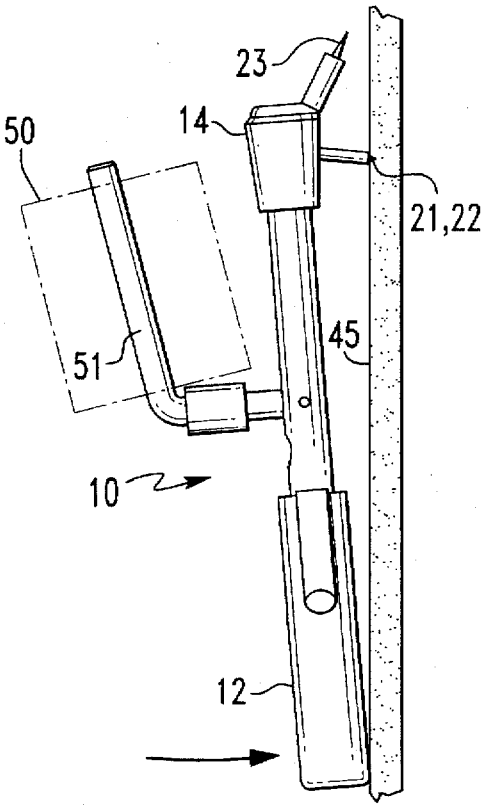

In a second mode of use of the tool diagrammatically illustrated in FIGS. 4 and 5, the wallpaper hanger grips the elongate body member 10 by means of its handle 12, and swings or 'tacks' the distal end portion 14 of the tool against a region of a wall surface that is to eventually be covered by the web material and which is adjacent to an area that is to be immediately covered by the web material carried by the tool, as shown in FIG. 4. This swinging or 'tacking' of the distal end of the tool against the wall drives the pair of hard steel pin elements 21 and 22 through the wall surface, so that the distal end 14 of the tool becomes attached or 'tacked' to the wall surface 45.

Next, as shown in FIG. 5, the user allows the handle end 12 of the tool to rest against the wall. Because of the slightly downward inclination of the probe elements 21 and 22 into the wall, the handle end 12 of the tool is rotationally biased toward the wall surface, so as to also provide a 'tripod' like support for the elongate body 10 against the wall, with the probe elements 21 and 22 and the lower or handle end 12 of the tool forming the three points of the tripod. With a roll of web material, e.g., wallpaper border, mounted on shaft member 51, the installer may now readily unroll the web material as need to cover an adjacent wall surface area.

As will be appreciated from the foregoing description, the wall-attachable web storage tool of the present invention is configured to be easily and removably attached to a wall surface by the installer, without assistance and, once engaged with the wall surface, remains in a 'hands-free' wall-attached condition, securely supporting a roll of web material in proximity to the wall surface, in a manner that facilitates an installer's unrolling of wall paper border, as needed, for attachment to an adjacent area of the wall surface.

While we have shown and described an embodiment in accordance with the present invention, it is to be understood that the same is not limited thereto but is susceptible to numerous changes and modifications as known to a person skilled in the art, and we therefore do not wish to be limited to the details shown and described herein but intend to cover all such changes and modifications as are obvious to one of ordinary skill in the art.

What is claimed:

1. A tool for retaining a roll of web material relative to a generally vertical surface comprising:

a generally elongate body member having a handle end portion and a distal end portion;

a plurality of elements affixed to said distal end portion of said generally elongate body member, said elements being configured to pierce said vertical surface and cause said handle end portion of said generally elongate body member to be urged away from said generally vertical surface, such that said generally elongate body member is self-attached to said generally vertical surface by said plurality of elements piercing said vertical surface and said handle end portion of said generally elongate body member being urged away from said generally vertical surface; and a shaft member supported on said generally elongate body member in spaced apart relation to said generally elongate body member, said shaft member adapted to receive said roll of web material, so that with said generally elongate body member being self-attached to said generally vertical surface, said roll of web material will be retained thereby in spaced apart relation to said vertical surface.

2. A tool according to claim 1, wherein said shaft member is generally L-shaped and has a first leg attached to a location of said generally elongate body member between said handle end portion and said distal end portion thereof, and a second leg extending from said first leg alongside and spaced apart from said distal end portion of said generally elongate body member, said second leg of said rod adapted to receive said roll of web material.

3. A tool according to claim 2, wherein said generally elongate body member includes an indented surface portion adjacent to said location of said generally elongate body member at which said first leg is attached.

4. A tool according to claim 2, further including a sleeve rotatable about said first leg of said generally L-shaped shaft member, so as to facilitate rotation of said roll of web material about said second leg of said generally L-shaped shaft member.

5. A tool according to claim 1, wherein said shaft member is tilted at an angle relative to said generally elongate body member such that with said generally elongate body member being self-attached to said generally vertical surface, said shaft member is generally parallel to said surface.

6. A tool according to claim 1, wherein said plurality of elements comprise a plurality of probe-configured elements extending from said distal end portion of said generally elongate body, member said plurality of probe-configured elements having stand-off elements thereon, such that piercing of said surface by said probe-configured elements causes said stand-off elements to engage said surface and urge said handle end portion of said generally elongate body member into rotation about said stand-offs.

7. A tool according to claim 6, wherein said plurality of elements include a further probe-configured element extending from said distal end portion of said generally elongate body member at an angle toward said distal end of said generally elongate body member, said further probe-configured element having a stand-off element thereon, such that piercing of said surface by said plurality of probe-configured elements and said further probe-configured element forms a multi-probe element support structure for attaching said tool to said generally vertical surface, such that said handle end of said generally elongate body member is spaced apart from said generally vertical surface.

8. A tool according to claim 7, wherein said plurality of probe-configured elements comprise metallic pointed probe elements passing through respective sleeve-configured stand-offs and extending from said distal end portion of said generally elongate body member, such that pointed ends of said probe elements project beyond said sleeve-configured stand-offs and allow piercing of said surface by said probe elements, up to engagement by said sleeve-configured stand-offs with said surface, thereby causing said handle end portion of said generally elongate body member to be pivoted about said stand-offs, whereby said generally elongate body member is retained at said surface by means of said plurality of probe elements piercing said surface.

9. A tool according to claim 1, wherein said shaft member is tilted at an angle relative to said generally elongate body member such that with said generally elongate body member being self-attached to said generally vertical surface, said shaft member is generally parallel to said surface.

10. A tool according to claim 1, further including a clip element supported on said generally elongate body member to enable said tool to hang from a pocket, belt or the like when not in use, such that said elements have a safe orientation relative to an individual using said tool.

11. A method of retaining a roll of web material in proximity to a generally vertical wall surface comprising the steps of:

(a) providing a tool for rotationally supporting said roll of web material, said tool comprising a generally elongate body member having a handle end portion and a distal end portion, a plurality of wall surface piercing elements affixed to said distal end portion of said generally elongate body member, and a shaft member supported on said generally elongate body member in spaced apart relation to said generally elongate body member, said shaft member rotationally supporting said roll of web material; and (b) inserting said plurality of wall surface piercing elements into a location of said wall surface and allowing said handle end portion of said generally elongate body member to pivot about said location of said wall surface, with said elongate body member becoming self-attached to said generally vertical wall surface by means of said plurality of elements piercing said vertical wall surface and said handle end portion of said generally elongate body member being supported by said self-attachment, whereby said roll of web material is retained by said tool in spaced apart relation to said vertical wall surface.

12. A method according to claim 11, wherein said shaft member comprises is generally L-shaped and has a first leg attached to a location of said generally elongate body member between said handle end portion and said distal end portion thereof, and a second leg extending from said first leg alongside and spaced apart from said distal end portion of said generally elongate body member, said second leg of said rod rotationally supporting said roll of web material, and wherein said shaft member is tilted at an angle relative to said generally elongate body member, such that, with said generally elongate body member being self-attached to said generally vertical wall surface in step (b), said shaft member is generally parallel to said wall surface.

13. A method according to claim 11, wherein said plurality of elements comprise a plurality of probe-configured elements extending from said distal end portion of said generally elongate body member at an angle relative to said handle end of said generally elongate body member, said plurality of probe-configured elements having stand-off elements thereon, such that inserting of said probe-configured elements into said wall surface in step (b) causes said stand-off elements to form a fulcrum engagement of said wall surface and urge said handle end portion of said generally elongate body member into rotation about said stand-offs.

14. A tool for retaining a roll of web material relative to a generally vertical surface comprising:

a generally elongate body member having a handle end portion and a distal end portion;

a plurality of elements affixed to said distal end portion of said generally elongate body member, said elements being configured to pierce said vertical surface and secure said tool to said wall at said distal end portion, and maintain said handle end portion of said generally elongate body member spaced apart from said generally vertical surface, such that said generally elongate body member is self-attached to said generally vertical surface by said plurality of elements piercing said vertical surface, and said handle end portion of said generally elongate body member remains spaced apart from said generally vertical surface; and a shaft member supported on said generally elongate body member in spaced apart relation to said generally elongate body member, said shaft member being adapted to receive said roll of web material, so that when said generally elongate body member is self-attached to said generally vertical surface, said roll of web material will be retained thereby in spaced apart relation to said vertical surface.

15. A tool according to claim 14, wherein said shaft member is generally L-shaped, having a first leg attached to a location of said generally elongate body member between said handle end portion and said distal end portion thereof, and a second leg extending from said first leg alongside and spaced apart from said distal end portion of said generally elongate body member, said second leg of said rod adapted to receive said roll of web material, and further including a sleeve rotatable about said first leg of said generally L-shaped shaft member, so as to facilitate rotation of said roll of web material about said second leg of said generally L-shaped shaft member.

16. A tool according to claim 14, wherein said plurality of elements comprise a plurality of probe-configured elements extending from said distal end portion of said generally elongate body member and having stand-off elements thereon, such that piercing of said surface by said probe-configured elements causes said stand-off elements to engage said surface and maintain said handle end portion of said generally elongate body member spaced apart from said generally vertical surface.

17. A tool according to claim 14, wherein said plurality of probe-configured elements comprises a pair of metallic pointed probe elements passing through respective sleeve-configured stand-offs and extending from said distal end portion of said generally elongate body member, such that pointed ends of said probe elements project beyond said sleeve-configured stand-offs and allow piercing of said surface by said probe elements, up to engagement by said sleeve-configured stand-offs with said surface, thereby causing said handle end portion of said generally elongate body member to be pivoted about said stand-offs and away from abutment with said generally vertical surface, whereby said generally elongate body member is retained at said surface by means of said pair of probe elements piercing said surface.

* * * * *